US005285558A

United States Patent [19]

Carder et al.

[11] Patent Number: 5,285,558

[45] Date of Patent: Feb. 15, 1994

[54] PILE CARPET BEVELER-TRIMMER APPARATUS

[76] Inventors: William E. Carder, 4 Spyglass Hill Rd., Fairport, N.Y. 14450; Timothy Carder, 310 Cromwell Dr., Rochester, N.Y. 14610

[21] Appl. No.: 854,868

[22] Filed: Mar. 19, 1992

[51] Int. Cl.[5] ..... D06C 13/08

[52] U.S. Cl. ..... 26/7; 26/2 R; 26/8 R; 30/376

[58] Field of Search ..... 26/8 R, 2 R, 7, 13, 26/1, 9, 10 R; 30/476, 376

[56] References Cited

U.S. PATENT DOCUMENTS

| | | | |
|---|---|---|---|
| 687,653 | 11/1901 | Rivollier | 26/8 R |
| 882,313 | 3/1908 | von Hofe | 26/8 R |
| 1,557,345 | 10/1925 | Schumacher | 26/8 R |
| 1,850,692 | 3/1932 | Roger, Jr. | 26/8 R |
| 2,088,162 | 7/1937 | Cook | 26/7 |
| 2,554,529 | 5/1951 | Herron | 26/8 |
| 5,016,328 | 5/1991 | Gilpatrick | 26/7 |

*Primary Examiner*—Clifford D. Crowder
*Assistant Examiner*—Amy B. Vanatta
*Attorney, Agent, or Firm*—Shlesinger, Fitzsimmons & Shlesinger

[57] ABSTRACT

A heavy, roller-mounted base plate has thereon a conventional pile carpet trimmer having a shearing head disposed to be swung into and out of a pile access opening in the base plate either to trim the pile of a carpet by sliding the plate on top of the pile, or to bevel the carpet edge by sliding the plate beneath and along one edge of the carpet. Attached to the plate adjacent opposite ends of its pile access opening are two, linearly aligned guide members, which slidably engage a carpet edge during a beveling operation. A retention bracket projects from one of the guide members to overlie the pile surface to prevent any bunching or folding of the carpet edge during the edge-beveling operation.

18 Claims, 3 Drawing Sheets

PILE CARPET BEVELER-TRIMMER APPARATUS

BACKGROUND OF THE INVENTION

This invention relates to pile carpet trimming devices, and more particularly to an improved apparatus for beveling carpet edges and forming bas-relief designs or patterns in pile carpet surfaces.

Pile carpet inlays and bas-relief carpet designs have become an increasingly popular alternative to custom carpet manufacture due to the obvious differences in both cost and design restrictions. Designs can be created and inlays highlighted by using trimming and/or beveling techniques on pile carpet surfaces to produce variations in the carpet pile height. Also, finished edges are produced by beveling prior to the addition of trim material to the fringe. Such techniques usually are performed on the carpet surface and edges with the use of pneumatic or electric shears having a pair of toothed blade members which laterally reciprocally move relative to one another for engagement of the teeth thereon with the designated carpet pile.

U.S. Pat. No. 2,088,162 discloses a pile carpet trimming and beveling apparatus comprising electrically powered shears that are vertically and rotatably adjustably attached to a base plate for producing carpet designs with varying pile depths and angular cuts. This prior art, however, is not particularly suited for trimming carpet edges, and utilizes intricately assembled parts which would be too expensive competitively to produce in today's marketplace. The U.S. Pat. No. 4,970,790 also discloses pile carpet carving apparatus comprising a pile cutter or trimming device pivotally mounted above a base plate for vertical and angular adjustment thereof for producing designs having varying depths and angular cuts. Such an assembly, however, also lacks any means for controlling the uniform beveling of the carpet edge, and is limited with regard to the maximum attainable beveling angle.

It is therefore an object of this invention to provide improved pile carpet trimming and beveling apparatus which is capable of performing uniform beveling of a pile carpet edge.

It is also an object of this invention to provide carpet trimming and beveling apparatus of the type described which is capable of producing infinitely adjustable cuts of varying depth and angle.

Still another object of this invention is to provide for apparatus of the type described a roller-mounted base plate for expediting bevel edging operations.

Other objects of this invention will become apparent hereinafter from the specification and the recital of the appended claims, particularly when read in conjunction with the accompanying drawings.

SUMMARY OF THE INVENTION

Each embodiment of this invention is intended to be used with any conventional pile carpet cutter or trimming device. The apparatus comprises a heavy, roller-mounted base plate having an opening therein disposed to provide the shearing head of a conventional trimming device access to the surface of a carpet. A support stand is slidably mounted to the upper surface of the base plate for selective lateral adjustment towards or away from the opening. Projecting from one side of the support stand rearwardly of the opening is a clamp fixture having adjustably mounted therein the housing of a conventional trimming device. The clamp fixture is mounted on the support stand for pivotal adjustment about a horizontal axis, thereby permitting the head of the trimming device to be swung vertically relative to the access opening in the base plate. The housing of the trimming device is also rotatably adjustable within the clamp fixture. Collectively, these adjustable features of the trimming device allow the assembly effectively to operate on both the surface and edges of a pile carpet.

Also attached to the base plate adjacent opposite ends of its pile access opening are two, linearly aligned guide members, which facilitate the beveling operation on carpet edges. Attached to the lead guide member is a retention bracket whose position thereon may be vertically adjusted, such that a generally planar retainer thereon may be positioned to engage the surface of carpets of varying thickness for the purpose of preventing any bunching or folding of the carpet edge which could disrupt the edge-beveling operation. Together, the guide members and the retention bracket provide a means for maintaining a uniformly beveled linear cut to the carpet edge.

DETAILED DESCRIPTION OF THE PREFERRED EMBODIMENTS

Figure 1:
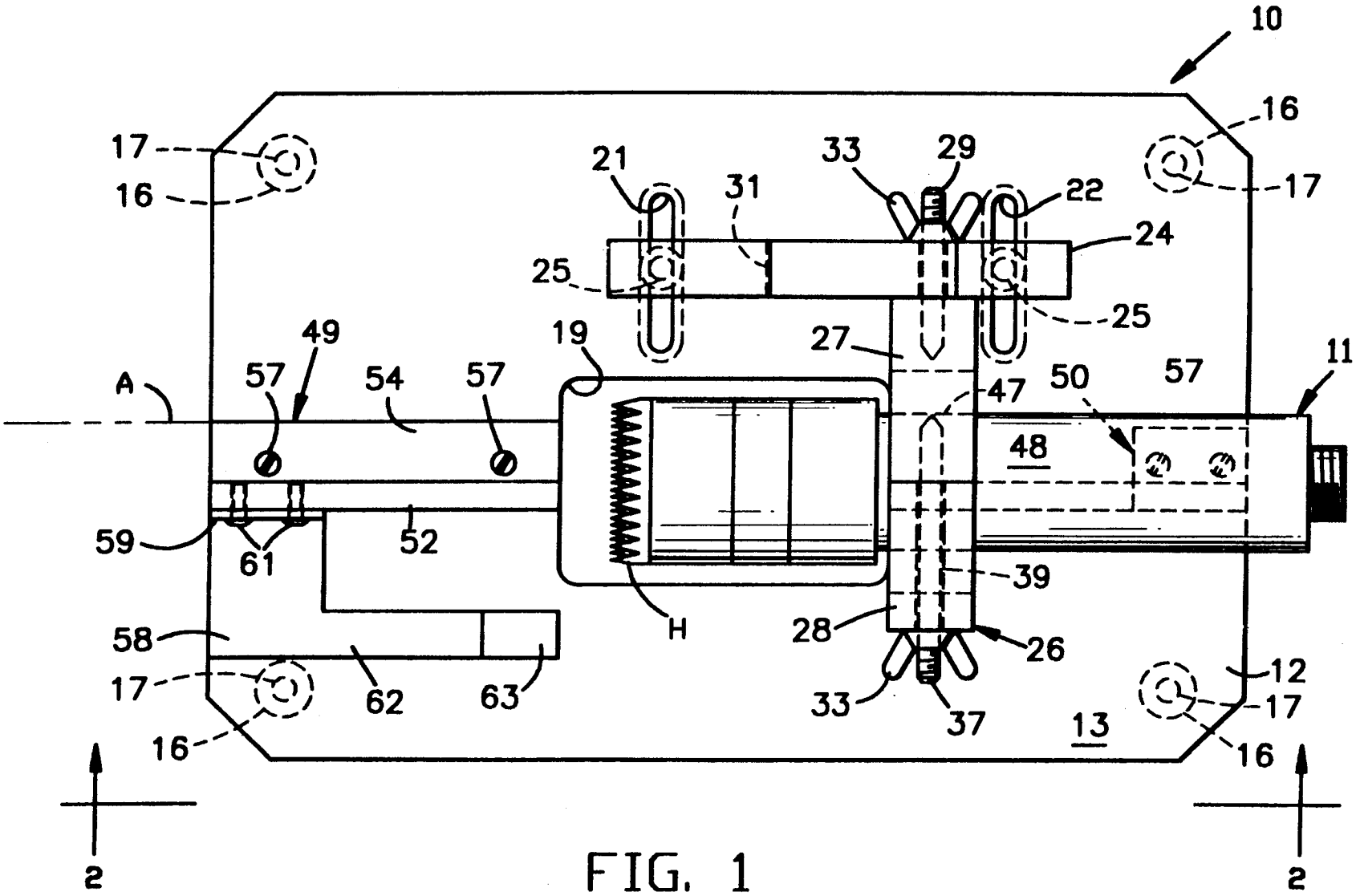
FIG. 1 is a plan view of a bevel-trimmer assembly made according to one embodiment of the present invention.

Referring now to the drawings by numerals of reference, and first to FIGS. 1-3, 10 denotes generally the improved carpet trimming and beveling apparatus; and 11 denotes generally a conventional trimming device which forms part of this apparatus. Trimming device 11 may be any electrically or pneumatically powered carpet trimmer, such as for example the pneumatic carpet trimming device disclosed in my U.S. Pat. No. Re33,756.

Apparatus 10 includes also an elongate polygonal base plate 12 having parallel, planar upper and lower surfaces 13 and 14, respectively. Rotatably supported by conventional ball retainers 16 in each of four rectangularly spaced recesses in the underside of plate 12 are four ball casters 17, each of which projects slightly beneath the plane bottom surface 14 of plate 12. Base plate 12 also has therethrough a rectangular opening 19, which is slightly laterally offset from the longitudinal centerline A (FIG. 1) of the plate, and a pair of identical, parallel slots 21 and 22 which extend perpendicular to axis A. Attached to the upper surface 13 of base plate 12 to extend vertically upwardly therefrom and transversely across the upper ends of slots 21 and 22 is a support stand or plate 24. Plate 24 is adjustably secured to plate 12 by bolts 25 (FIGS. 1 and 3) the shanks of which extend through slots 21 and 22 and thread into the lower edge of plate 24. Loosening of the bolts 25 allows stand 24 to be selectively and slidably moved in a lateral direction, either towards or away from opening 19 for a purpose to be noted hereinafter.

Numeral 26 denotes generally a clamp fixture which is pivotally secured to support stand 24 for adjustment about an axis positioned above and parallel to plate 12 and its slots 21 and 22. Fixture 26 comprises two complimentary plate members 27 and 28, one of which, plate 27, is pivotally attached to stand 24 by a pair of spaced, parallel bolts 29 and 30, each of which threads at its inner end into one side edge of member 27. Intermediate their ends bolts 29 and 30 extend through respective openings 31 and 32 in plate 24, and have conventional wing nuts 33 threaded onto the outer ends thereof As shown more clearly in FIGS. 2 and 3, opening 31 in plate 24 is an elongate, arcuate slot disposed coaxially of the axis of bolt 30, and opening 32 is a circular bore having a diameter slightly larger than that of bolt 30. As a consequence, when wing nuts 33 are loosened, as noted hereinafter, the entire clamp fixture 26 may be pivotally adjusted for approximately 90° about the axis of bolt 30.

Figure 4:
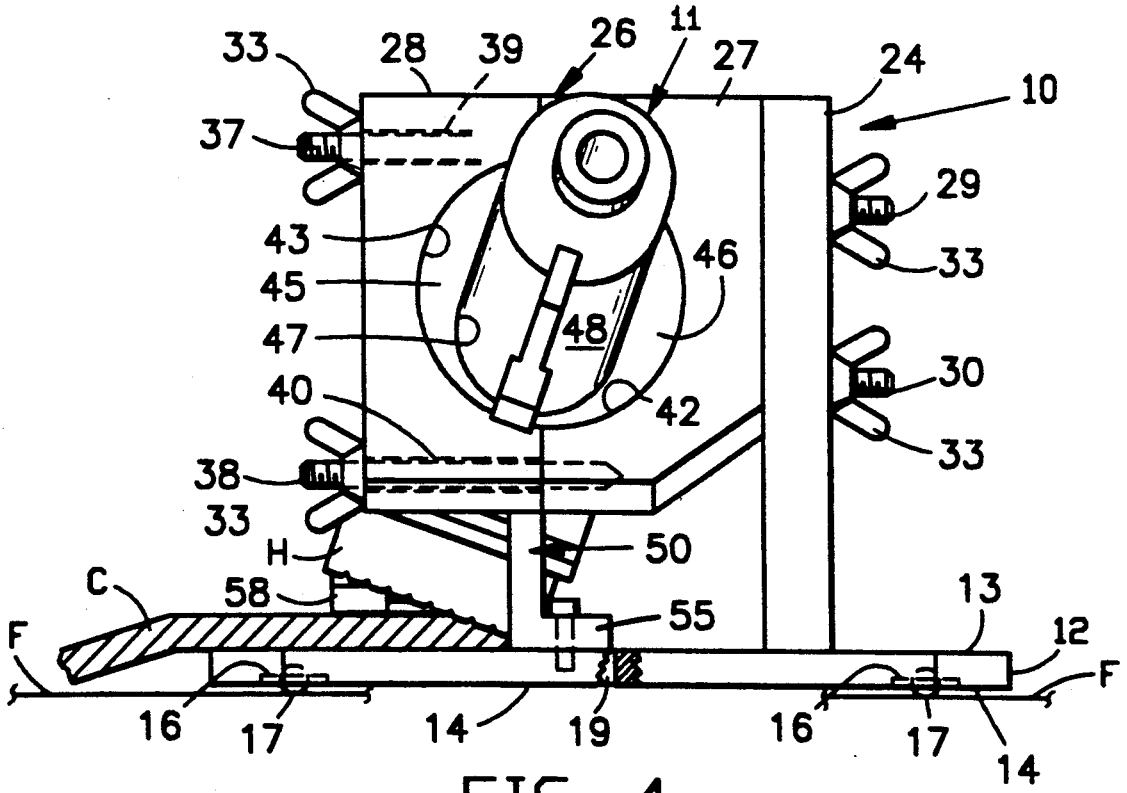
FIG. 4 is a rear elevational view similar to FIG. 3, but showing the trimming device as it appears in use performing a beveled cut to the edge of a carpet.

The clamp plate member 28 is attached to the complimentary member 27 by means of a pair of bolts 37 and 38, which are threaded at their inner ends into the edge of member 27 remote from plate 24, and which pass intermediate their ends through, and in slightly radially spaced relation to the walls of, parallel cylindrical bores 39 and 40 that extend completely through member 28. Bolts 37 and 38 also have externally threaded outer ends upon which conventional wing nuts 33 are adjustably threaded The complimentary members 27 and 28 have in their confronting edges semicircular recesses 42 and 43, respectively, such that when the members 27 and 28 are bolted together in confronting relation, recesses 42 and 43 form a circular aperture. Conformably seated within the confronting recesses 42 and 43 for rotatable adjustment therein are two, identical, arcuate gripping members 45 and 46 (FIGS. 3 and 4) having outer peripheries similar to recesses 42 and 43, and which have in their confronting sides semi-oval recesses that collectively form a generally oval receptacle 47 disposed circumferentially to engage the body 48 of the trimming device 11. Device 11 is secured within the clamp fixture 26 by first loosening the wing nuts 33 on bolts 37 and 38, and moving the member 28 away from the complimentary member 27 for a distance sufficient to allow housing 48 of the device to be placed into the generally oval receptacle 47 formed by the gripping members 45 and 46, and then tightening the wing nuts 33 on bolts 37 and 38 so that the device 11 is immovable within the gripping members 45 and 46.

Also attached to the upper surface 13 of base plate 12 are spaced guide members 49 and 50. Guide member 49 extends from the leading edge of plate 12 (left edge as shown in FIG. 1) to the opening 19, and has an upright planar face 52 lying in a plane normal to the plate surface 13, and parallel to axis A. Guide member 50 extends from the opening 19 to the rear edge of plate 12 and has an upright planar face 53 also lying in a plane parallel to axis A and in coplanar relation to face 52. The guide members 49 and 50 are generally L-shaped in cross sectional configuration and have base sections 55 and 56, respectively, which are anchored to the upper surface 13 of plate 12 by screws 57.

Figure 2:
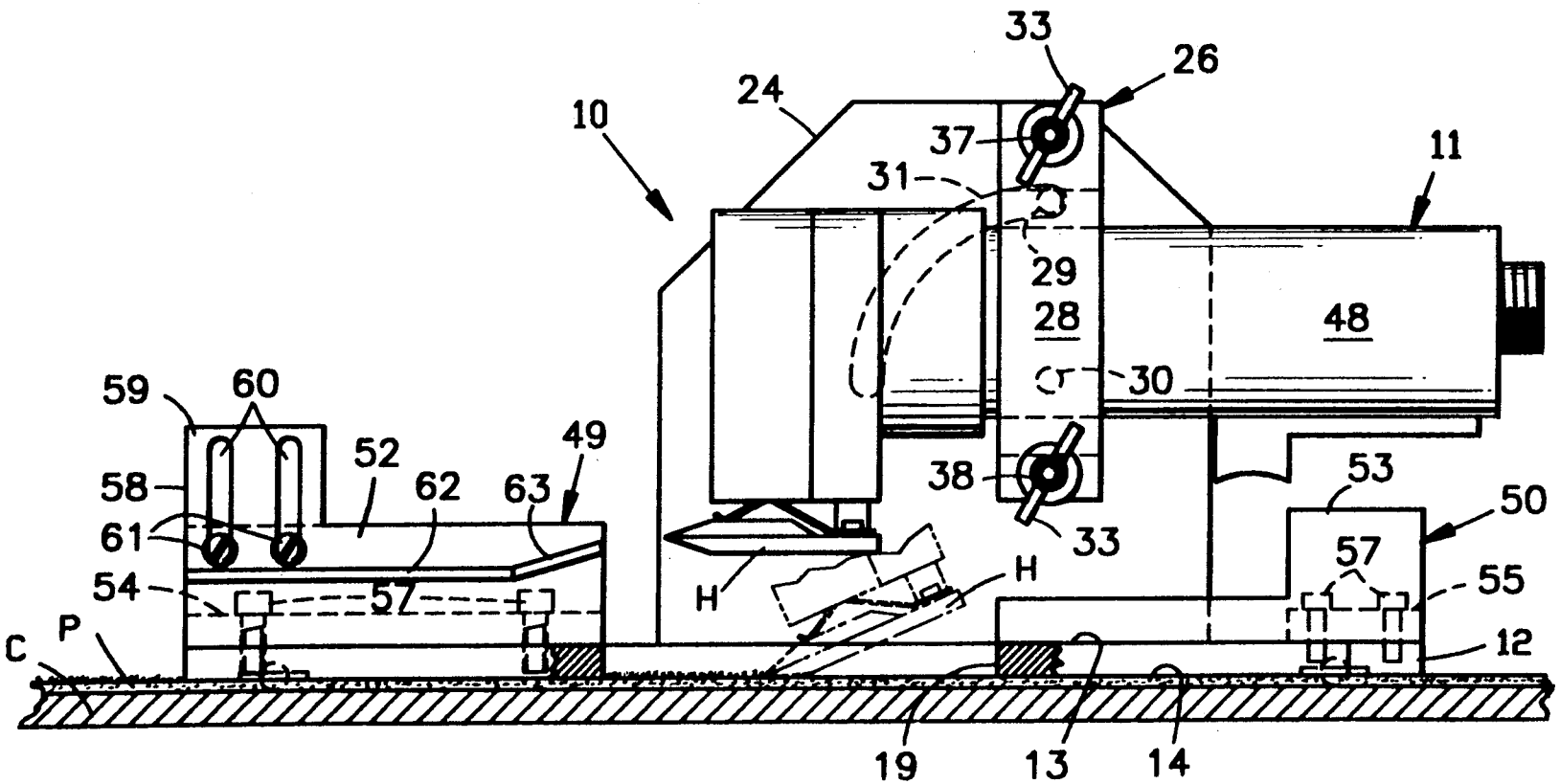
FIG. 2 is a side elevational view of this assembly taken generally along line 2—2 of FIG. 1 looking in the direction of the arrows, with a portion of the base plate being broken away and shown in section, and with the trimming head being shown in phantom as it appears after being adjusted to perform a uniform depth cut in the pile surface of a carpet.
Figure 3:
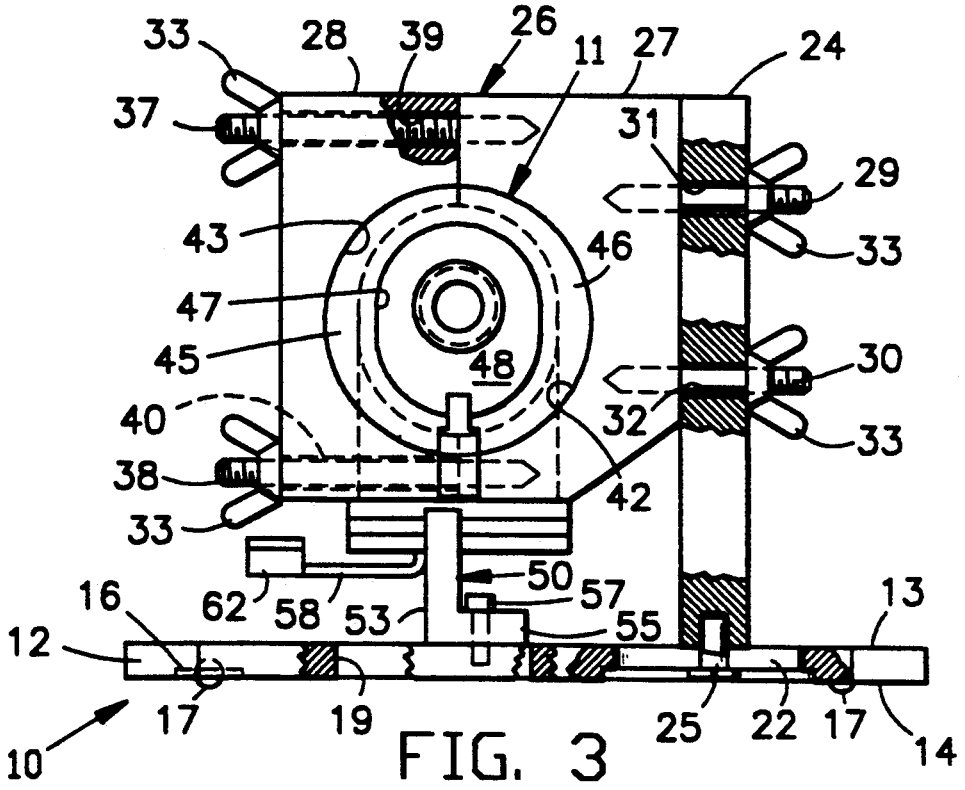
FIG. 3 is a rear elevational view of the assembly as seen when viewing the right end of the apparatus as shown in FIG. 2, and with portions thereof being broken away and shown in section.

Slidably attached to the face 52 of guide member 49 near the lead edge of base plate 12 is a bracket 58, which is adjustable downwardly towards or upwardly away from the plate surface 13. Bracket 58 comprises a vertically disposed mounting section 59 that has therein a pair of parallel slots 60 (FIG. 2) for accommodating the screws 61 which secure the bracket to the face 52 of guide member 49, and a horizontally disposed, nearly planar, L-shaped retainer section 62 that projects perpendicularly outwardly from face 52 parallel to the upper surface 13 of plate 12. Retainer 62 has a slightly inclined inner end 63 that points in the direction of trimming device 11, and which as shown in FIG. 2 is bent slightly upwardly.

The carpet trimming apparatus 10 has preferentially been designed to create evenly beveled carpet edges by utilizing the guide members 49 and 50 to align the carpet edge, and the bracket 58 to retain the carpet against upper plate surface 13. In addition, by using a heavy base plate 12 with opening 19 and a slidably adjustable support stand 24, the apparatus 10 also provides exceptional capabilities in performing uniform depth trimming and internal beveling operations. In use, therefore, each of these operations may be performed after making minor adjustments to the carpet trimming apparatus 10.

For producing uniform depth cuts into the pile surface P of a carpet C, the apparatus is placed on top of the carpet (FIG. 2) with the lower surface 14 of plate 12 resting on the pile surface. The wing nuts 33 surrounding bolts 29 and 30 are loosened to allow clamp 26 to pivot downwardly about bolt 30 such that the shearing head H of the trimming device 11 is swung from its inoperative position (solid lines in FIG. 2) to a position as shown in phantom where it contacts the carpet pile at a desired depth. The wing nuts 33 are then tightened about bolts 29 and 30, thereby locking clamp 26 in the desired position. Device 11 is then turned on to cause the toothed blade members in head H to reciprocate relative to one another, and the heavy plate 12 is slid along the pile surface P in a predetermined course thereby to create a desired pattern. During this movement the casters 17 perform no significant function, and do not project far enough from beneath the plate surface 14 to impede motion of plate 12.

For producing beveled cuts in the pile surface of the carpet, the plate 12 is placed on top of the carpet pile, and the wing nuts 33 on bolts 37 and 38 are loosened to allow members 45 and 46, and hence trimming device 11 manually to be rotated such that the cutting edge of head H is no longer parallel to base plate 12. Once the desired angular displacement is reached, nuts 33 may be tightened around bolts 37 and 38, and the clamp 26 may be pivoted downwardly and locked in place when the cutting head H has reached a desirable depth in the carpet pile P. Again, the device 11 may then be turned on and the plate 12 guided along a predetermined course on the pile surface in order to create the desired pattern.

In cases where the desired bevel angle is quite large, the rotational adjustment of housing 48 may disrupt the alignment of the cutting head H with the opening 19 in base plate 12. To compensate for any such misalignment, the bolts or screws 25 may be loosened to allow support stand 24 to be moved away from opening 19 such that the cutting head may again be aligned with opening 19. Once properly realigned, the stand 24 may be releasably retained in its new position until further operations warrant its change.

For beveled cuts to the carpet edge (FIG. 4), the casters 17 of plate 12 are positioned on the floor F beneath one edge of the carpet C so that a portion of the carpet overlies a portion of plate 12. This one edge of the carpet is positioned against guide members 49 and 50 such that the edge partially covers the opening 19. Once thus aligned, the carpet is retained against the upper surface 13 of base plate 12 by means of the adjustable bracket 58, which is vertically adjusted so that retainer 62 thereon is pressed into contact with the pile surface of the carpet. This will insure that the carpet edge does not bunch or fold prior to reaching the cutting head of trimming device 11. After fixing the retainer 62 in place, the bevel angle may be selected by rotatably adjusting the gripping members 45 and 46 and consequently device 11 as previously described, and then the device is pivoted to place its head H into engagement with the carpet. Once the desired adjustments have been made, device 11 may be turned on and the plate 12 is rolled along the floor F on its casters 17 for the entire length of the particular carpet edge. It is important to note that once the beveling operation has begun, it is imperative that the carpet edge maintain contact with both guide members 49 and 50 in order to insure that the carpet edge is uniformly beveled in a linear fashion.

Although this invention has been described in connection with a pair of gripping members 45 and 46 which define an oval receptacle 47, it should be apparent to one skilled in the art that the receptacle 47 may take on any shape or form which will accommodate the body of a conventional trimming device 11, and that this embodiment has been described in connection with only one such conventional trimming device. Also, it should be noted that although the bracket 58 has been described in connection with a particularly shaped retainer 62, it should apparent to one skilled in the art that the retainer 62 may take on alternative forms which will perform the same function equally as well. Furthermore, it is important to use a heavy base plate 12 to assure accurate trimming and beveling, and although the plate has been shown to be mounted on roller casters, it will be apparent that other types of rollers or wheels may be utilized without departing from this invention. Also, the edge guiding surfaces or faces 52 and 53 could be shaped to lie in an arcuate plane or path if the edge of a circular carpet, or the like, is to be beveled.

While this invention has been illustrated and described in detail in connection with only certain embodiments thereof, it will be apparent that it is still capable of further modification, and that this application is intended to cover any such modifications as may fall within the scope of one skilled in the art or the appended claims.

We claim:

1. Apparatus for selectively beveling the edges and trimming the pile of pile carpets, comprising a base plate having an upper surface, a lower surface, and opposed side edges, said plate having therethrough a pile access opening laterally spaced from one side edge of the plate, and having an upper end opening on said upper surface of the plate, and said plate being disposed to be moved on top of a pile carpet during a pile trimming operation and beneath and along an edge of the carpet during an edge beveling operation, a shearing device comprising a housing and a shearing head having thereon an elongate cutting edge, means mounting said device on the upper surface of said plate for adjustment between an edge beveling position in which said cutting edge extends above and transverse to said upper end of said access opening, and a pile trimming position in which said cutting edge extends downwardly into said opening for shearing engagement with the pile of a pile carpet, and carpet edge guiding means secured on said upper surface of said plate and defining adjacent opposite sides of said access opening a pair of spaced guiding surfaces positioned in an imaginary path extending transversely across said access opening, said plate being disposed during an edge beveling operation to have said one side edge thereof inserted beneath the edge of a carpet which is to be beveled, so that a marginal portion of said carpet overlies said plate and a portion of said access opening, and said edge of the carpet is slidably engaged with said spaced guiding surfaces when said plate is moved along said edge of the carpet to affect the beveling thereof.

2. Apparatus as defined in claim 1, wherein said spaced guiding surfaces lie in a common plane extending transverse to said upper surface of said plate.

3. Apparatus as defined in claim 1, wherein said edge guiding means includes at least one further guiding surface extending transversely outwardly from one of said pair of spaced guiding surfaces toward said one side edge of said plate, and above said upper surface of said plate, thereby to overlie and have sliding engagement with the pile surface of said marginal portion of said carpet during an edge beveling operation.

4. Apparatus as defined in claim 1, wherein said edge guiding means comprises a first guide member attached to said upper surface of said plate adjacent one end thereof, said first guide member having thereon a planar face extending transverse to said upper surface of said plate and defining one of said pair of spaced guiding surfaces, and a second guide member attached to said upper surface of said plate adjacent the opposite end thereof, said second guide member having a planar face extending transverse to said upper surface of said plate and coplanar with said face on said first guide member, and defining the other of said pair of spaced guiding surfaces.

5. Apparatus as defined in claim 4 wherein said edge guiding means further includes means for retaining said marginal portion of said carpet against said upper surface of said plate during movement of said plate along said edge of the carpet.

6. Apparatus as defined in claim 5, wherein said retaining means comprises a bracket mounted for vertical adjustment on one of said guide members, said bracket having thereon a planar surface projecting from said planar face on said one guide member parallel to said upper surface of said plate, and disposed to overlie the top of said carpet.

7. Apparatus as defined in claim 1, wherein said means mounting said shearing device on said plate, comprises means supporting said device on said plate for pivotal adjustment about a first axis extending parallel to the plane of said plate and transverse to said imaginary path, and said supporting means including means for effecting rotational adjustment of said device about a second axis extending transverse to said cutting edge of said head.

8. Apparatus as defined in claim 7, wherein said means for supporting said device for pivotal adjustment comprises, a support secured to and projecting upwardly from the upper surface of said plate, a first clamp member pivotally secured to said support by a bolt, the axis of said bolt defining said first axis about which said device pivots, and a second clamp member releasably secured to said first clamp member in confronting relation thereto, said clamp members having in each of two confronting surfaces thereof a semicircular recess, which recesses collectively define a circular aperture, said circular aperture having seated therein said means for effecting rotational adjustment of said device about said second axis.

9. Apparatus as defined in claim 8, wherein said means for effecting rotational adjustment comprises a pair of gripping members, said gripping members having semicircular outer peripheral surfaces seated coaxially in said circular aperture, and said gripping members having recesses in their confronting sides which collectively form a receptacle disposed circumferentially to engage said housing of said device.

10. Apparatus as defined in claim 9, wherein said gripping member are substantially identical to each other in configuration.

11. Apparatus as defined in claim 8, including means mounting said support on said plate for limited adjustment selectively toward and away from said one side edge of said plate.

12. Apparatus as defined in claim 1, including a plurality of casters rotatably mounted in recesses formed in the lower surface of said plate, and engageable with a plane surface to support said plate for rolling movement thereon during an edge beveling operation.

13. Apparatus for supporting a carpet trimming device for selectively performing beveling and trimming operations on pile carpet, comprising a base plate having opposed side edges, and having an opening therethrough disposed to accommodate the cutting edge of a carpet trimming device, and said plate having planar upper and lower surfaces, respectively, said lower surface being disposed to slide on top of a nearly planar pile carpet surface during beveling and trimming operations, means for supporting a carpet trimming device on the upper surface of said plate with the cutting edge of said device registering with said opening in said plate, said supporting means including a support member slidably attached to said upper surface of said plate for lateral adjustment thereon in a direction extending transverse to said opposed side edges, and selectively towards and away from said opening;

means for mounting said carpet trimming device on said support member for adjustment therewith laterally of said opening, and for pivotal adjustment relative thereto about a first axis extending parallel to said upper surface of said plate, thereby to adjust the cutting edge of said device in one direction relative to said opening, and said mounting means including means for adjusting said device about a second axis transverse to said first axis thereby to incline said cutting edge relative to said upper surface of said plate.

14. Apparatus as defined in claim 13, wherein said means mounting said device for pivotal adjustment comprises, a first clamp member pivotally secured to said support member by a bolt, said bolt defining said first axis about which said device pivots, a second clamp member releasably secured to said first clamp member, and said clamp members having in confronting surfaces thereof semicircular recesses which collectively define a circular aperture, said circular aperture having seated therein said means for adjusting said device about said second axis.

15. Apparatus as defined in claim 14, wherein said clamp members are pivotal about said first axis between inoperative positions wherein said cutting edge of said device is positioned above a carpet surface positioned beneath said opening, and an operative position wherein said cutting edge extends downwardly through said opening to engage said carpet surface.

16. Apparatus for beveling the edges of carpets, comprising a base plate having an upper surface, a lower surface, and opposed side edges, and being disposed to have a portion adjacent one side edge thereof slide beneath and along an edge portion of a carpet during the beveling of the edge of said carpet, guiding means secured on the upper surface of said plate and defining thereon at least one upstanding guiding surface spaced from said one side edge of said plate, and disposed to have sliding engagement with said edge of the carpet that is being beveled, a shearing device comprising a housing and a shearing head having thereon an elongate cutting edge, and means mounting said device on the upper surface of said plate for adjustment into an edge beveling position in which said shearing head is positioned adjacent said guiding surface with said cutting edge thereof disposed to engage said carpet edge at an angle inclined to said upper surface of said plate and to the plane of said carpet.

17. Apparatus as defined in claim 16, including a second guiding surface spaced from said one guiding surface, and said guiding surfaces lie in a common plane extending transverse to said upper surface of said plate.

18. Apparatus as defined in claim 16, wherein said guiding means includes at least one further guiding surface extending transversely outwardly from said one guiding surface to overlie said upper surface of said plate and the edge of the carpet that is to be beveled.

* * * * *